US009173789B2

(12) United States Patent
Haskell et al.

(10) Patent No.: US 9,173,789 B2
(45) Date of Patent: Nov. 3, 2015

(54) RAPID INTERVENTION RESCUE DEVICE

(75) Inventors: Frank Haskell, West Islip, NY (US); Thomas J. Fee, South Hempstead, NY (US); Michael P. Harty, West Islip, NY (US)

(73) Assignee: MFT Internal Inc., West Islip, NY (US)

( * ) Notice: Subject to any disclaimer, the term of this patent is extended or adjusted under 35 U.S.C. 154(b) by 101 days.

(21) Appl. No.: 13/476,558

(22) Filed: May 21, 2012

(65) Prior Publication Data

US 2012/0272451 A1 Nov. 1, 2012

Related U.S. Application Data

(63) Continuation-in-part of application No. 12/025,028, filed on Feb. 2, 2008, now Pat. No. 8,286,284.

(60) Provisional application No. 60/980,768, filed on Oct. 17, 2007, provisional application No. 60/887,932, filed on Feb. 2, 2007, provisional application No. 61/488,014, filed on May 19, 2011.

(51) Int. Cl.

| | |
|---|---|
| ***A61G 1/013*** | (2006.01) |
| ***A61G 1/01*** | (2006.01) |
| *A61G 1/044* | (2006.01) |
| *A61G 7/05* | (2006.01) |

(52) U.S. Cl.

CPC . *A61G 1/01* (2013.01); *A61G 1/044* (2013.01); *A61G 7/0504* (2013.01)

(58) Field of Classification Search

CPC ..... A61G 1/013

USPC ..... 5/627–628, 625, 89.1, 81.1 T; 182/3

See application file for complete search history.

(56) References Cited

U.S. PATENT DOCUMENTS

| | | | | |
|---|---|---|---|---|
| 722,456 | A | | 3/1903 | Reeves |
| 2,279,694 | A | | 4/1942 | Martinson |
| 2,788,530 | A | | 4/1957 | Ferguson |
| 2,899,692 | A | | 8/1959 | Finken |
| 3,158,875 | A | | 12/1964 | Fletcher |
| 3,424,134 | A | | 1/1969 | Rosenblum |
| 4,124,908 | A | | 11/1978 | Burns et al. |
| 4,159,010 | A | * | 6/1979 | Mitro ..... 5/89.1 |
| 4,283,068 | A | | 8/1981 | Keyser |
| 4,679,260 | A | | 7/1987 | Frettem |
| 4,937,923 | A | | 7/1990 | McEntire |

(Continued)

FOREIGN PATENT DOCUMENTS

| | | |
|---|---|---|
| EP | 0301614 | 2/1989 |
| EP | 1400227 | 3/2004 |
| GB | 1536191 | 12/1978 |

OTHER PUBLICATIONS

PCT/ISA/237 Written Opinion issued on PCT/US2008/052868 (pp. 4).

(Continued)

*Primary Examiner* — Fredrick Conley

(74) *Attorney, Agent, or Firm* — The Farrell Law Firm, P.C.

(57) ABSTRACT

An emergency drag stretcher is disclosed that combines a base panel formed of a flexible sheet material and a harness. The harness securely restrains an individual and holds the base panel against the individual, allowing the individual to be dragged or vertically lifted using the emergency drag stretcher.

13 Claims, 14 Drawing Sheets

(56) References Cited

U.S. PATENT DOCUMENTS

| | | | | |
|---|---|---|---|---|
| 4,970,739 | A | 11/1990 | Bradford | |
| 5,027,833 | A | 7/1991 | Calkin | |
| 5,044,031 | A | 9/1991 | Sherwood et al. | |
| 5,050,254 | A | 9/1991 | Murphy | |
| 5,058,575 | A | 10/1991 | Anderson | |
| 5,121,514 | A | 6/1992 | Rosane | |
| 5,189,746 | A | 3/1993 | Horie | |
| 5,435,323 | A | 7/1995 | Rudy | |
| 5,539,945 | A | 7/1996 | Rosenberg et al. | |
| 5,701,619 | A | 12/1997 | Ullman | |
| 5,720,303 | A | 2/1998 | Richardson | |
| 5,729,850 | A | 3/1998 | Eskeli | |
| 5,787,529 | A | 8/1998 | Landes | |
| 5,839,137 | A | 11/1998 | Butler et al. | |
| 5,960,480 | A | 10/1999 | Neustater et al. | |
| 5,978,989 | A | 11/1999 | Chavez | |
| D421,413 | S | 3/2000 | Calkin | |
| 6,101,631 | A * | 8/2000 | Ferguson, Jr. | 2/94 |
| 6,128,796 | A | 10/2000 | McCormick et al. | |
| 6,363,936 | B1 | 4/2002 | McCormick et al. | |
| 6,634,044 | B1 | 10/2003 | Wright | |
| 6,662,372 | B2 * | 12/2003 | Lewis et al. | 2/69 |
| 6,851,145 | B2 | 2/2005 | Smith et al. | |
| 6,871,368 | B2 | 3/2005 | Calkin | |
| 6,880,702 | B1 | 4/2005 | Colorado | |
| D512,535 | S * | 12/2005 | Willows et al. | D29/122 |
| 7,086,091 | B2 | 8/2006 | Jordan | |
| 7,168,110 | B2 | 1/2007 | Girard et al. | |
| 7,222,378 | B2 | 5/2007 | DuPree et al. | |
| 7,596,815 | B2 | 10/2009 | Grilliot et al. | |
| 7,607,184 | B1 | 10/2009 | Goodner, Jr. | |
| D608,253 | S | 1/2010 | Giduck | |
| 7,665,152 | B2 | 2/2010 | Sloan et al. | |
| 7,699,324 | B2 | 4/2010 | Walkingshaw et al. | |
| 7,865,986 | B2 | 1/2011 | Smart | |
| 8,430,204 | B1 * | 4/2013 | Reynolds | 182/3 |
| 2004/0088794 | A1 * | 5/2004 | Calkin | 5/628 |
| 2004/0128767 | A1 | 7/2004 | Hood | |
| 2006/0061050 | A1 | 3/2006 | Wolf et al. | |
| 2006/0169534 | A1 | 8/2006 | Green | |
| 2007/0136950 | A1 * | 6/2007 | Zuercher | 5/627 |
| 2008/0018067 | A1 | 1/2008 | Small | |

OTHER PUBLICATIONS

PCT/ISA/210 Search Report issued on PCT/US2008/052868 (pp. 3).
Skedco, Mass Casualty Haz-Mat/Decontaminable (HMD) SKED Stretcher—Brochure.

* cited by examiner

RAPID INTERVENTION RESCUE DEVICE

PRIORITY

This application claims priority to U.S. Provisional Application No. 61/488,014 filed May 19, 2011, and is a continuation in part application of U.S. application Ser. No. 12/025,028, which filed Feb. 2, 2008 and issued as U.S. Pat. No. 8,286,284 on Oct. 16, 2012, which claims priority to U.S. Provisional Application No. 60/980,768 filed Oct. 17, 2007, to U.S. Provisional Application No. 60/887,932 filed Feb. 2, 2007, and to International Application No. PCT/US08/52868 filed Feb. 3, 2008, each of which are incorporated herein by reference.

BACKGROUND

1. Field of the Invention

The present invention relates generally to an emergency rescue device and method for operation thereof to enable rapid removal of an injured individual from hazardous locations and, more specifically, emergency rescue device that combines a base panel formed of a flexible sheet material and a harness coupled to the base panel to securely restrain the injured individual.

2. Description of the Related Art

Stretchers of various types have been developed to move injured individuals. Stretchers of different types and configurations have also been developed to safely and efficiently move an injured individual from an emergency situation, for example an individual found injured in a burning building or a soldier injured on a battlefield.

A conventional emergency stretcher is provided by Skedco, Inc. that combines features of a sled and a skid, and is often referred to as a 'SKED'. Components of the SKED are disclosed in U.S. Pat. No. 6,871,368 to Calkin. The SKED is manufactured from a single piece of material, can be stored flat, and is manipulated by a user into a functioning configuration. An injured individual is loaded onto the SKED device, which is then skidded across varied types of terrain.

However, the individual is secured within the SKED device using a plurality of pairs of conventional seat-belt style straps, and the plastic used to manufacture the SKED device has a shape memory. This arrangement creates an inefficient and time consuming process to secure the injured individual.

Moreover, the SKED device does not provide a self-contained packing arrangement to protect the straps and also position the straps for immediate deployment. Rather, a separate cover is needed to protect the straps of the SKED device. Use of such separate cover further delays deployment of the SKED device.

Accordingly, the SKED device does not ensure an efficient process for securing an injured individual. The delays in deploying the SKED device are undesirable, particularly if the SKED device is used in emergency situations.

Another conventional drag-style emergency evacuation stretcher is disclosed by U.S. Pat. No. 7,699,324 to Walkingshaw et al. ("Walkingshaw"). Like the SKED, the Walkingshaw device is manufactured from a single piece of material. The Walkingshaw device can be stored flat and is folded into a functioning configuration. Also like the SKED, the Walkingshaw device utilizes a conventional seat-belt style straps to secure an injured individual therein and fails to provide a self-contained packing arrangement that protects the straps from the elements while also maintaining the harness straps in a stored state that allows for immediate deployment.

Yet another conventional stretcher is U.S. Pat. No. 7,168,110 to Girard et al. ("Girard"), which discloses a transfer stretcher and harness for lifting, transferring or supporting a person—in particular an overweight person—via a single lift point, typically by use of lifting equipment. However, the transfer stretcher of Girard is not arranged for use as an emergency evacuation stretcher, particularly when immediate deployment is needed, such as for fire rescue or battlefield scenarios.

Another example of a conventional emergency stretcher is provided by U.S. Pat. No. 6,871,368 to Catkin, which a flexible drag stretcher that can be stored and transported in a tightly rolled, compact cylindrical storage condition for hand carrying and for mounting on a backpack, to be unrolled into an operative stretcher condition having a single center base panel formed of a flexible sheet material onto which a pair of opposite, flexible side torso flap members are mounted to cinch against the sides of only the torso portion of an injured person's body to secure the injured person to the stretcher during stretcher operation. However, like the other conventional stretchers, the emergency personal must follow numerous and time-consuming steps to secure the injured person in the device.

SUMMARY OF THE INVENTION

The present invention provides an apparatus and method providing a lightweight, readily compactable, rescue device for evacuation and emergency use including transporting, dragging and lifting of an injured individual.

An aspect of the present invention fully secures an injured individual without use of complex strapping configurations of conventional devices, thereby providing a more efficient device better suited for emergency evacuation. In addition, an aspect of the present invention provides a rescue stretcher that utilizes the body support member as a primary means for securely restraining the injured individual, with a harness strapping systems that fully secures the individual to allow for dragging operation, as well as multiple lift point operation.

Another aspect of the present invention provides a rescue device with fastening harness members that fasten to a single location for rapid deployment with a self-contained storage bag that protects the harness members from deterioration while allowing for immediate and rapid deployment of the harness members.

Yet another aspect of the present invention provides an emergency rescue device that combines a base panel formed of a flexible sheet material and a harness, with the harness having straps that fasten to a single location to securely restrain an injured individual while simultaneously holding the base panel against the individual, thereby allowing the individual to be dragged or vertically lifted using the stretcher device, while the base panel protecting the individual.

Another aspect of the present invention provides a rescue device that includes a harness bag for storing harness straps therein, to protect the straps during periods of non-deployment and facilitates expedited strap deployment. The harness bag includes a plurality of reinforced slots/slits through which the straps, including haul straps, shoulder straps, waist straps and groin straps, extend from within the harness bag interior. In a non-deployed state, excess strap slack is releasably held within the harness bag with connecting ends of each strap, including mating fasteners, being releasably secured on an exterior surface of the harness bag, with the straps passing through respective slots/slits. When in a deployed state, end portions of the straps are extracted from the harness bag to wrap the straps around the individual who is being restrained in the harness device.

A further aspect of the present invention provides a rescue device with a base panel removably coupled to a harness for securing an individual to be rescued when the rescue device is in the deployed state, with the harness being enclosed within and protected by the base panel when the rescue device is in the non-deployed state, when the base panel and the harness are rolled into a storage state.

DETAILED DESCRIPTION OF EXEMPLARY EMBODIMENTS

Figure 1:
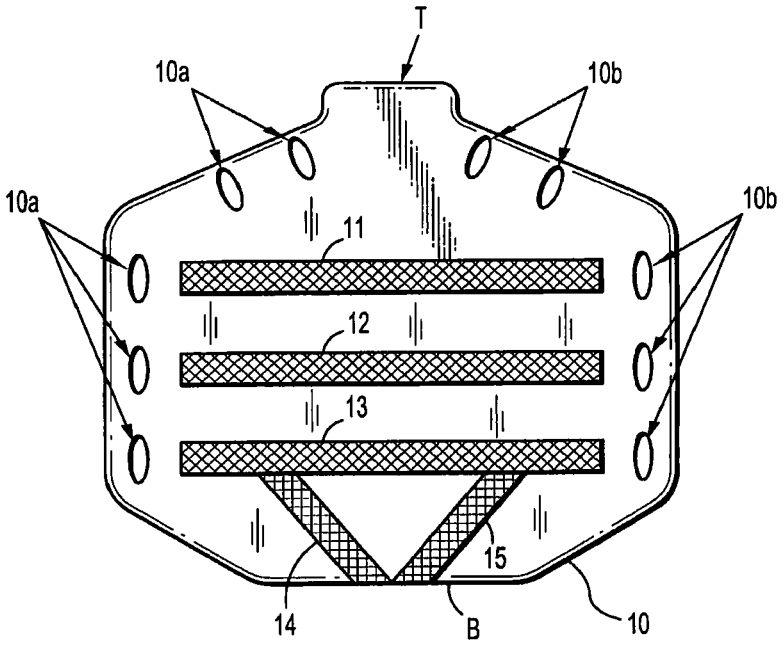
FIG. 1 illustrates a base panel of a rescue device according to an exemplary embodiment of the invention.
Figure 2:
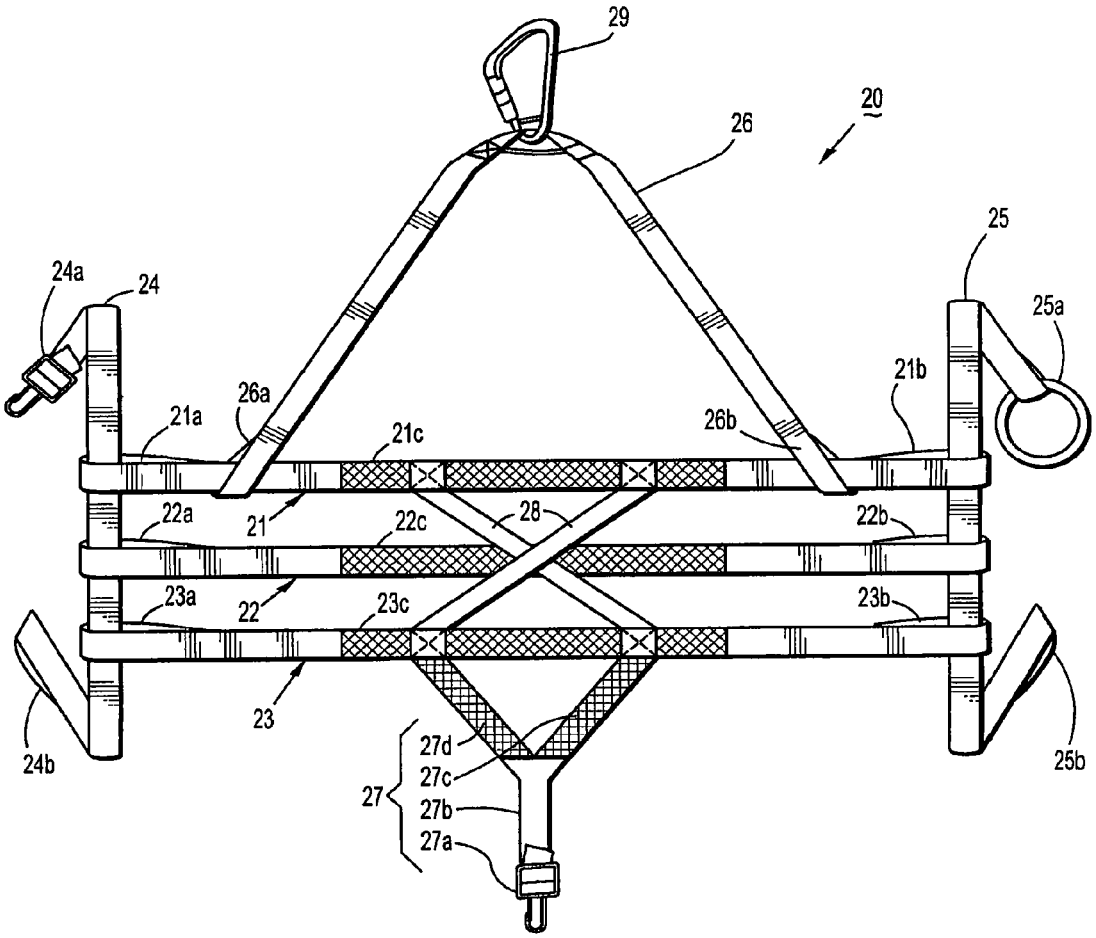
FIG. 2 illustrates a harness according to an exemplary embodiment of the invention, for use with the base panel shown in FIG. 1.
Figure 3:
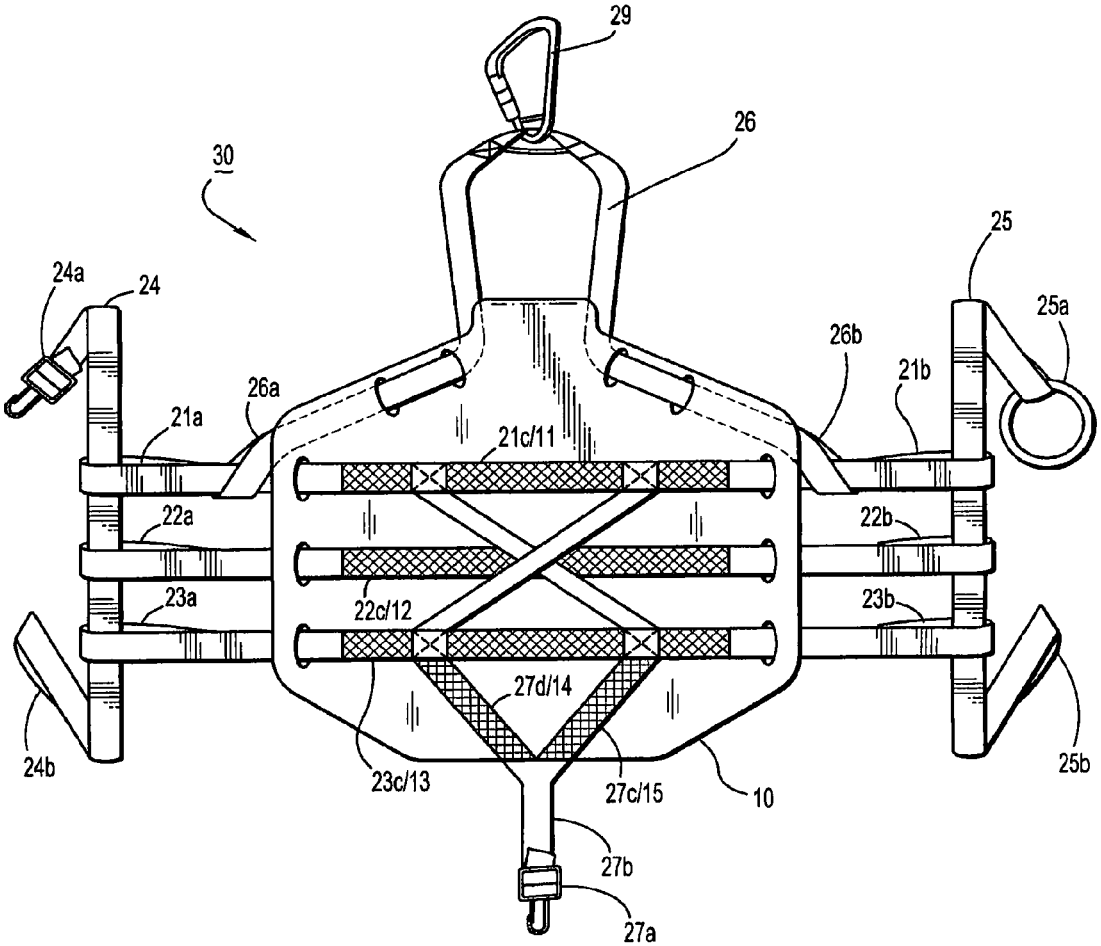
FIG. 3 illustrates the rescue device formed by the base panel and harness of FIGS. 1 and 2, respectively.

FIGS. 1-3 illustrate a rapid intervention rescue device according to an exemplary embodiment of the invention. In particular, FIG. 3 illustrates a rescue device (30) according to an exemplary embodiment of the invention, which includes a base panel (10) formed of a flexible sheet material, separately shown in FIG. 1, and a harness (20), which is separately shown in FIG. 2. The base panel (10) is formed of a flexible sheet material having a top end (T) and bottom end (B). The base panel (10) is preferably formed pliable plastic materials or polyurethane, preferably being flexible and not having a shape retaining memory, to provide hardness and durability to protect the individual being rescued. Preferably, base panel (10) does not retain any shape memory, to facilitate and expedite loading of an injured person by a single rescuer.

The base panel (10) includes a plurality of harness strap holes (10*a*) formed at various positions along a first side edge and a plurality of harness strap holes (10*b*) formed at various positions along a second side edge of the base panel (10). As explained below, the harness strap holes (10*a*, 10*b*) insertably receive portions of the harness straps in manner that allows the harness, such as shown in FIG. 2, to be coupled to the base panel (10) by lacing strap of the harness device through the holes (10*a*, 10*b*). The harness strap holes (10*a* 10*b*) can be cut or otherwise stamped in the sheet material forming the base panel (10) and such strap holes can be reinforced using metal, such as brass or stainless steel, or reinforced with plastic grommets. Moreover, the base panel (10) includes strips of Velcro™ (11-15) strategically placed in position to interface with mating Velcro™ strips affixed to regions along the various straps of the harness (20) and further serves to hold the harness (20) in position on the base panel (10).

FIG. 2 illustrates an exemplary harness (20) according to an exemplary embodiment of the invention, which may be used with the exemplary base panel (10) of FIG. 1. The harness (20) includes elongated cross-body straps (21-23) or waist straps, elongated holding straps (24, 25), a pull handle strap (26) or tow handle, and a groin strap (27). The elongated body straps (21-23) each have looped ends (21*a*, 21*b*), (22*a*, 22*b*) and (23*a*, 23*b*), respectively. A portion of respective body straps (21-23) may have Velcro™ strips (21*c*, 22*c*, 23*c*) attached thereto, which are designed to mate with corresponding Velcro™ strips (11-13) affixed on the base panel (10). The elongated body straps (21-23) are preferably interconnected by box stitching with a cross-strap (28).

The elongated holding strap (24) includes a locking clip fastener (24*a*) such as a snap clip connected on one end thereof and a looped end (24*b*). The elongated holding strap (25) includes a metallic ring fastener (25*a*), such as a bull ring, connected on one end thereof and a looped end (25*b*). The handle strap (26) includes an elongated length of strap material having first and second looped ends (26*a*, 26*b*). A connector (29), such as a carabineer, may be used to enable the handle strap (26) to be connected to a safety line device or other equipment, otherwise the handle (26) can be physically pulled by hand.

The groin strap (27) includes clip fastener (27*a*) and strap portions (27*b*, 27*c*, 27*d*) where the clip fastener (27*a*) is attached to one end of strap portion (27*b*) and where strap portions (27*c*, 27*d*) may have strips of Velcro™ attached thereto which are designed to mate with corresponding Velcro™ strips (14-15) on the base panel (10). The ends of the strap portions (27*c*, 27*d*) are box stitched to the elongate body strap (23). It should be understood that the cross-straps (28) and groin strap portions (27*c*, 27*d*) may be formed by two elongated lengths of strapping which are arranged and box stitched to the elongated body straps (21-23) in a way to form the cross strap layout with extended pieces forming the strap portions (27*c*, 27*d*). The groin strap (27) may have a ring connector connected to the groin strap portion (27*b*), where the strap portions (27*b*, 27*c* and 27*b*) meet, allowing connection to another carabineer (29) clip of another rescue device to form a connecting chain of rescue devices that can be pulled together to extricate multiple injured or dead individuals from a given location.

The harness (20) may be formed of any suitable strapping or webbing material that is rated for a desired strength and durability for the intended purposes. For example, in firefighting applications, the harness straps forming the harness (20) may be formed of flexible tubular webbing preferably formed of non-abrading, flame-resistant material that uses aramid fibers such as Kevlar™ and Nomex™. In other applications, the harness straps may be formed of nylon, polyester or other suitable materials.

FIG. 3 illustrates a drag rescue stretcher device (30) which includes an assembly of the exemplary base panel (10) and harness (20), wherein the harness (20) is removably connected to the base panel (10) by lacing portions of the harness straps through the strap holes in the base panel (10) and coupling the mating Velcro™ strips on the harness straps to the Velcro™ strips on the base panel (10). In particular, in the exemplary embodiment of FIG. 3, the harness (20) can be coupled to the base panel (10) by inserting the looped ends (21*a*, 22*a*, 23*a*) of the elongated straps (21-23) through corresponding strap holes (10*a*) on the left peripheral side edge of base panel (10) and by inserting the looped ends (21*b*, 22*b*, 23*b*) through corresponding strap holes (10*b*) on the right peripheral side edge of the base panel (10). The harness (20) is held in place on the base panel (10) via the corresponding mating Velcro™ strips (21*c*/11), (22*c*/12), 23*c*/13), (27*c*/15) and (27*d*/14) that are stitched to the portions of the elongate straps (21-23) and glued to the base panel (10).

Moreover, the pull handle strap (26) is laced through corresponding strap holes on the base panel (10) by inserting the looped end (26*a*) of the pull handle strap (26) through the upper strap holes (10*a*) and by inserting the looped end (26*b*) of the pull handle strap (26) through the upper strap holes (10*b*). The pull handle strap (26) is coupled to the harness waist straps by, e.g. inserting the looped end (21*a*) of the elongated body strap (21) through the looped end (26*a*) of the handle (26), and by inserting the looped end (21*b*) of the elongated body strap (21) through the looped end (26*b*) of the pull handle strap (26), as shown in FIG. 3. The holding strap (24) is laced through the looped ends (21*a*, 22*a*, 23*a*) of the elongated body straps (21-23) and the holding strap (25) is laced through the looped ends (21*b*, 22*b*, 23*b*) of the elongated body straps (21-23).

The drag rescue stretcher (30) can be deployed as follows. An injured individual is placed onto the base panel (10) with a torso of the individual aligned with the base panel (10). When maneuvering the individual onto the base panel (10), the harness device (20) will be maintained in proper position on the base panel (10) by, e.g. Velcro™ strip connections between the harness device (20) and base panel (10). When the individual is in proper position, the loose end of the groin strap portion (27*b*) with the clip fastener (27*a*) is passed between an individual's legs in the groin region such that the clip (27*a*) is brought to a front torso region of the individual. Moreover, the clip fastener (24*a*) of the holding strap (24) is passed through the looped end (24*b*) to form a closed loop and the clip fastener (24*a*) is brought to the front torso region of the individual. Similarly, the ring fastener (25*a*) of the holding strap (25) is passed through the looped end (25*b*) to form a closed loop, and the ring fastener (25*a*) is brought to the front torso region of the individual, where the clip fastener (24*a*, 27*a*) are connected to the ring fastener (25*a*). In this manner, the harness (20) essentially encloses and surrounds the torso of the individual. The lengths of the elongated body straps (21-23) and holding straps (24, 25) are preferably designed such that the harness (20) is relatively tightly secured around the torso of the individual upon connection of the clips (24*a*, 27*a*) to the ring (25*a*) with the side portions of the base panel (10) being drawn against the sides of the individual.

Figure 4:
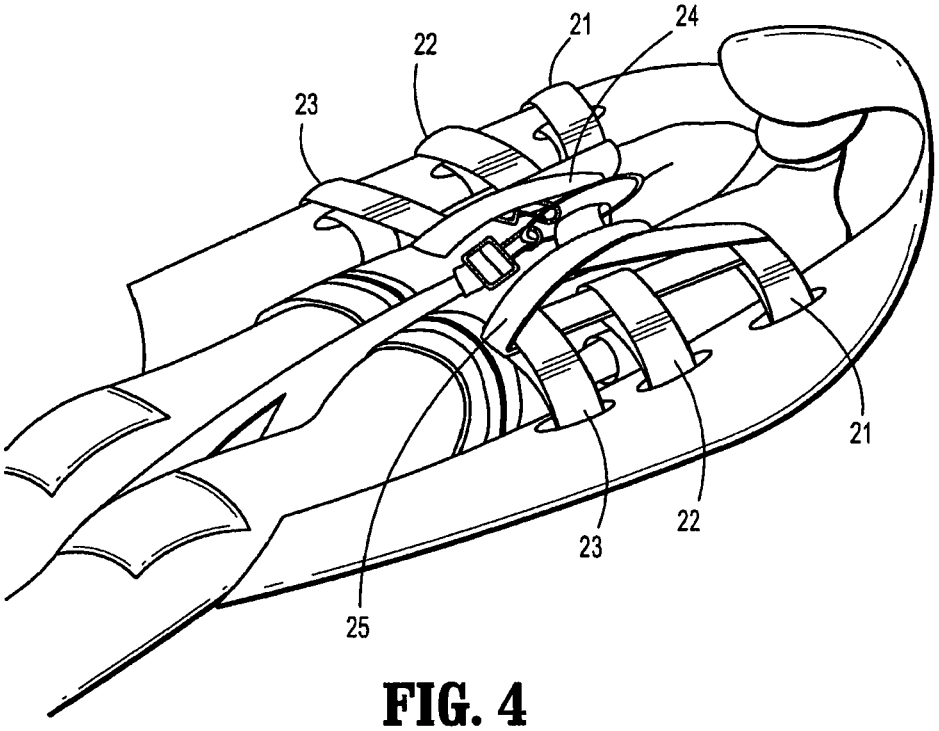
FIG. 4 shows the rescue device of FIG. 3 operatively supporting an injured individual.

FIG. 4 is a perspective view of the assembly of FIG. 3 operatively deployed to secure an injured individual. In operation, the drag rescue stretcher can be used to drag an individual where the base panel (10) is designed to readily slide over various surfaces while protecting the back and side torso regions of the individual. Moreover, the drag rescue stretcher (30) can be used for vertical lift applications where the carabineer (29) is hooked to a haul line to pull the individual out of a hole or up a flight of stairs, for example. The dimensions of the base panel (10) can vary depending of the application. For example, the overall width of the base panel (10) can be made sufficiently wide to wrap around the sides and backside of the torso, as shown in FIG. 4. Moreover, the base panel (10) has a length sufficient to receive and support the individual's head and torso. In the embodiment shown in FIG. 4, the individual's legs and hips can bend while secured to the stretcher device (30), to facilitate extrication from confined places and where tight turns must be navigated, e.g. firefighting applications where an injured firefight must be dragged through winding hallways of a burning home or building. In other embodiments, the base panel (10) is provided in a length that supports full-body protection, preferably by inclusion of a separate panel that is removably attached to the bottom end (B) of the base panel (10) and is extends away from the base panel (10) for leg support, to provide a full length drag stretcher device.

The pull handle strap (26) is used to pull the drag rescue stretcher (30) while the individual is secured therein. In the exemplary embodiment of FIG. 3, the pull strap handle (26) is not fixedly attached to the base panel (10) and does not pull directly on the base panel (10) during a drag or lift operation. Instead, the looped ends (26*a*, 26*b*) of the harness handle (26) are slideably attached to the looped ends (21*a*, 21*b*) of the upper elongated body strap (21) such that in effect, the handle (26) actually pulls on the harness (20) in which the individual is secured. In the exemplary embodiment of FIG. 3, the pulling of the handle (26) operates to remove slack and more tightly secure and cinch the harness (20) around the torso region. The clip fasteners (24*a*, 27*a*) on the holding strap (24) and groin strap (27) may allow for adjustment of the length of the strap members (24, 27), so as to accommodate individuals of different size and bulk, and to permit an individual to be fully and positively secured, while using the pulling action of the handle on the elongated body strap (21) to effectively remove any slack in the harness (20) and more tightly cinch the harness (20) around the individual.

Figure 5:
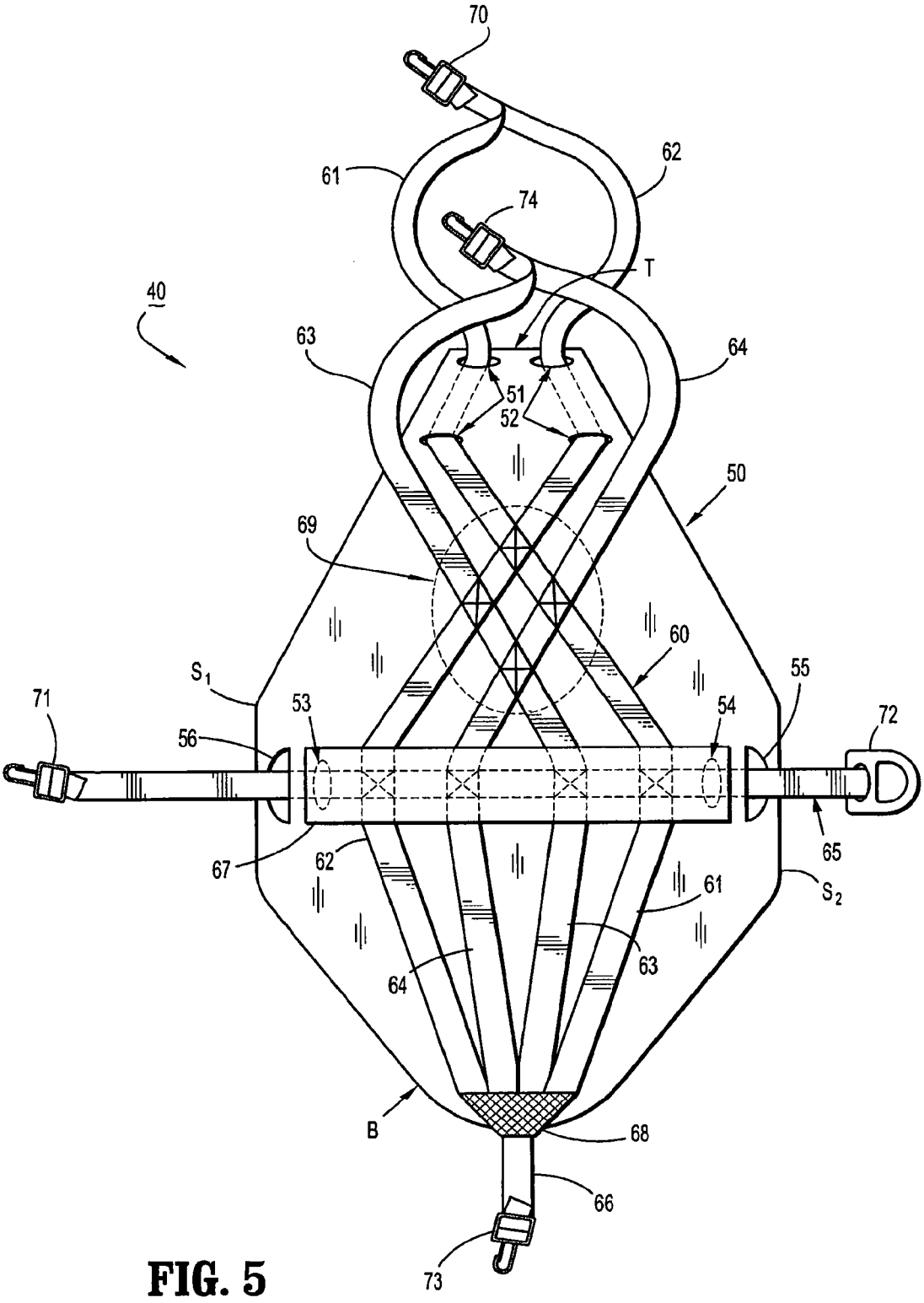
FIG. 5 illustrates a drag stretcher device according to another exemplary embodiment of the invention.

FIG. 5 illustrates a drag rescue stretcher device (40) according to another exemplary embodiment of the invention, which includes an assembly of a base panel (50) and a harness (60). In general, the base panel (50) is formed of a flexible sheet material having a plurality of apertures (51-56) formed at top (T) and side regions (S1, S2) of the base panel (50). The apertures (51, 52, 53 and 54) are preferably formed as thin slots to insertably receive harness straps of the harness (60). The apertures (55, 56) are preferably formed to serve as handles that enable a rescuer to grab the drag stretcher base panel (50) by hand when necessary. The harness (60) includes elongated straps (61-64) that extend between top (T) and bottom (B) ends of the base panel (50), an elongated waist strap (65) that extends between sides S1 and S2 of the base panel (50), a groin strap (66) that is disposed at the bottom region of the base panel (50), and a support pad (67) that acts as a lumbar support.

Figure 6:
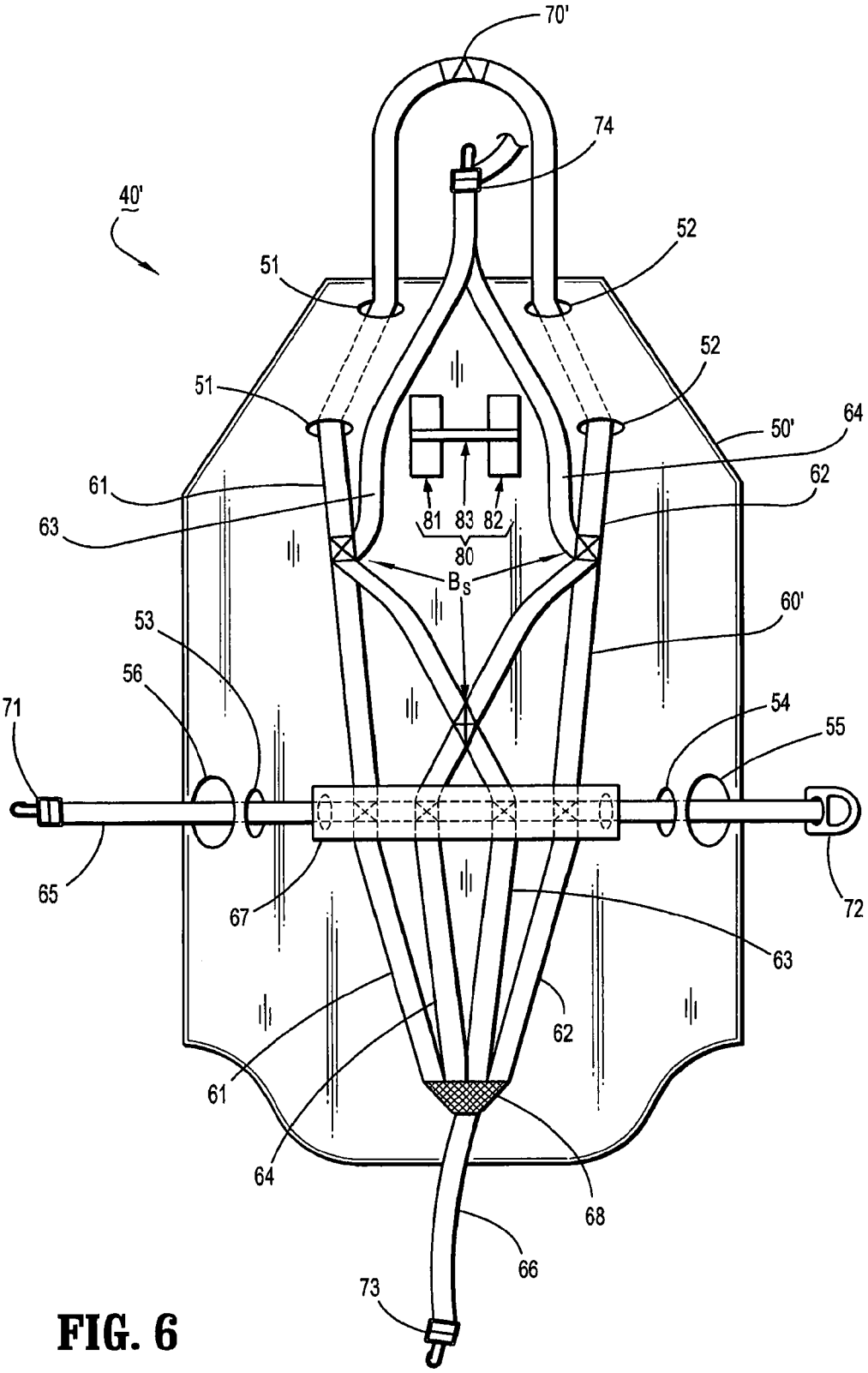
FIG. 6 illustrates a drag stretcher device according to another exemplary embodiment of the invention.

At the top end (T) of base panel (50), end portions of the elongated straps (61-62) are looped through respective aperture pairs (51-52) and are connected to form a pull handle strap. A connector (70) may be used to connect the end portions of straps (61-62) and to assist in dragging. Other means for connecting the ends of straps (61-62) may be used to form the strap loop, such as connecting the ends of the straps (61-62) via a water knot (70'), as shown in FIG. 6. The connector (70) facilitates expedited connection of the handle strap to a safety line device or other equipment; and also allows the handle strap to be physically pulled by hand.

Moreover, end portions of the elongated straps provide a pair of shoulder straps (63-64) that are connected at distal ends thereof via a clip fastener (74) to form shoulder harness straps, as shown in FIGS. 5-9. The elongated straps (61-64) are connected to each other via box stitching and arranged in a crisscross pattern in region (69), as shown in FIG. 5. The elongated straps (61-64) are further fixedly attached to a backside of the support pad (67), as shown in FIGS. 5-6. The end portions of the elongated straps (61-64) converge at a bottom (B) of the base panel (50) and are connected to an end of the groin strap (66) via box stitch connection region (68), as shown in FIGS. 5-7 and 9. Proximal ends of each strap of the pair of shoulder straps are fixedly connected to a proximal end of the groin strap at the box stitch connection region (68). The groin strap (66) includes clip fastener (73).

The straps (61-62) are preferably formed from one continuous strap element that is folded and stitched at the box stitch connection region (68). Similarly, the elongated strap members (63-64) are preferably formed from one continuous length of strap that is folded and stitched at the box stitch connection region (68). The groin strap (66) may be an extended looped portion of the continuous strap element (63, 64). The waist strap (65) is fixedly attached, for example by box stitching, to a backside of the support pad (67). A first end of the waist strap (65) is looped through the aperture (53) and handle (56) and includes a metallic locking clip fastener (71), such as a snap clip. A second end of the waist strap (65) is looped through the aperture (54) and handle (55) and includes a metallic ring fastener (72), such as a bull ring, connected thereto to provide a single fastener to couple each end portion of each harness strap when securing an individual within the rescue harness.

The harness (60) is removably connected to the base panel (50) by inserting the ends of the elongated waist strap (65) through corresponding apertures (53-56) of base panel (50) and by inserting the ends of elongated straps (61-62) through corresponding apertures pairs (51-52) of base panel (50), as shown in FIG. 5.

The harness (60) may be formed of any suitable strapping or webbing material that is rated for a desired strength and durability for the intended purposes.

The drag rescue stretcher (40) can be deployed as follows. An injured individual is placed onto the base panel (50) with individual's torso aligned with the base panel (50). When maneuvering the individual onto the base panel (50), the harness (60) is maintained in proper position on the base panel (50) by the Velcro™ strip connections between the harness straps and base panel. When the individual is in proper position, the loose end of the groin strap (66) with the clip fastener (73) is passed between the individual's legs in the groin region such that the clip (73) is brought to the individual's front torso region. Moreover, the clip fastener (71) of the waist strap (65) is brought to the front torso region. Similarly, the ring fastener (72) of the waist strap (65) is brought to the front torso region, where the clip fasteners (71, 73) are connected to the ring fastener (72). Moreover, the shoulder strap loop formed by the connected ends of elongated straps (63-64) is looped over the individual's head and shoulders, whereby the clip fastener (74) is brought to the front torso region and connected to ring fastener (72). In this manner, the harness (60) encloses and surrounds the individual's torso. In other embodiments, a head support/strap system can be integrally connected to the base panel (50) in an upper region of the panel (50).

In other embodiments, the harness straps (61-64) may be arranged in region (69) in a layout other than the crisscross pattern (69) shown in FIG. 5. The crisscross pattern is advantageous to provide back support when an individual is strapped in the drag stretcher (40). The elongated straps (61-62) may be arranged to extend down either sides of the base panel (50) without crossing each other in region (69). For example, FIG. 6 schematically illustrates another exemplary embodiment of a drag rescue stretcher device (40') that includes an assembly of a harness (60') and base panel (50'), which is similar in design to the embodiment described in FIG. 5.

FIG. 6 further illustrates an exemplary head restraint device (80) that includes adjacent head pad restraint elements (81-82), between which the individual's head is positioned and secured by a strapping element (83).

In other exemplary embodiments of the invention, harness is formed with a harness housing or harness bag that serves various functions such as providing protection for harness webbing and strap storage when the harness device is not deployed.

Figure 7:
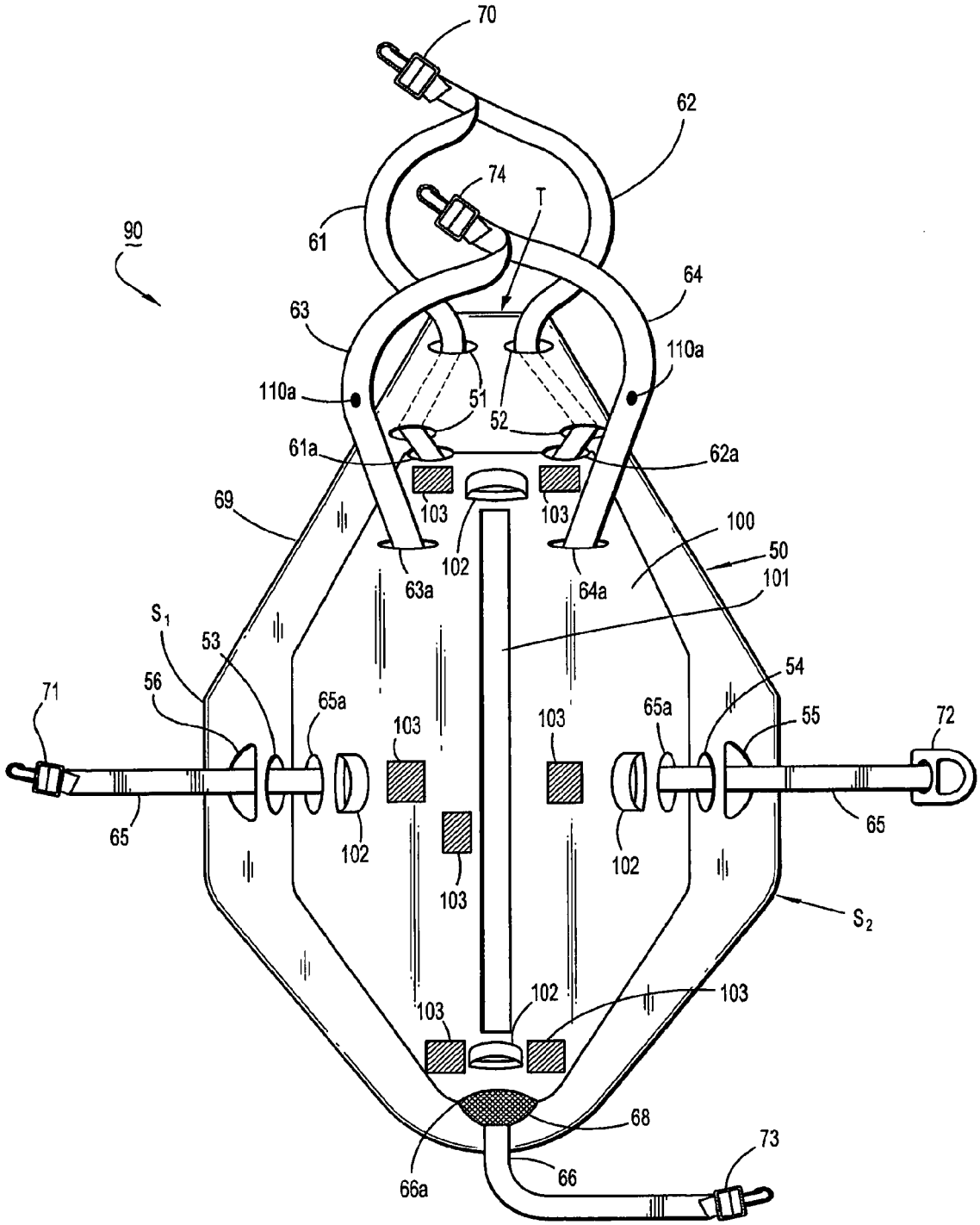
FIGS. 7-9 illustrate a drag stretcher device according to another exemplary embodiment of the invention, including a harness bag.
Figure 8:
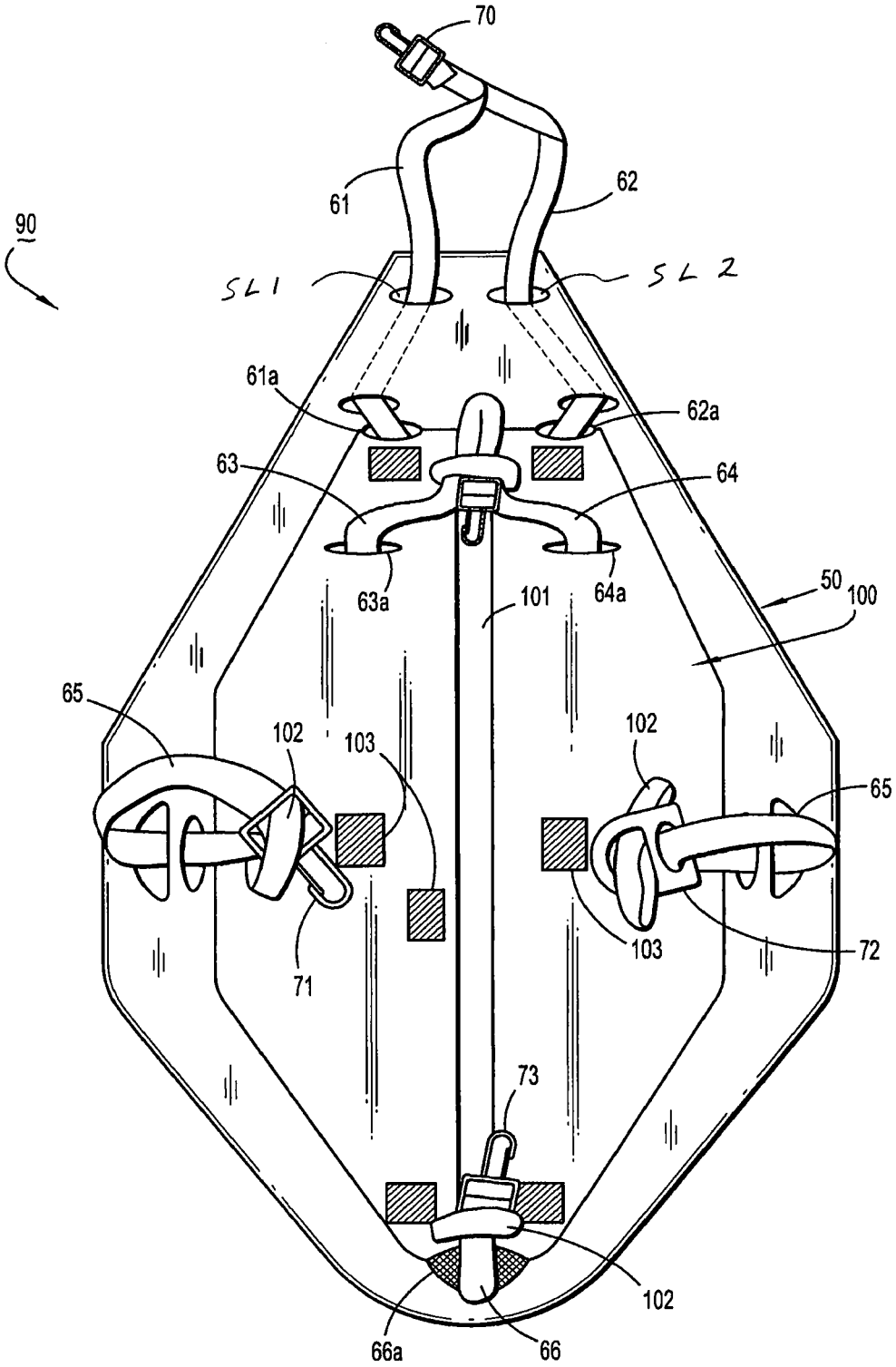
Figure 9:
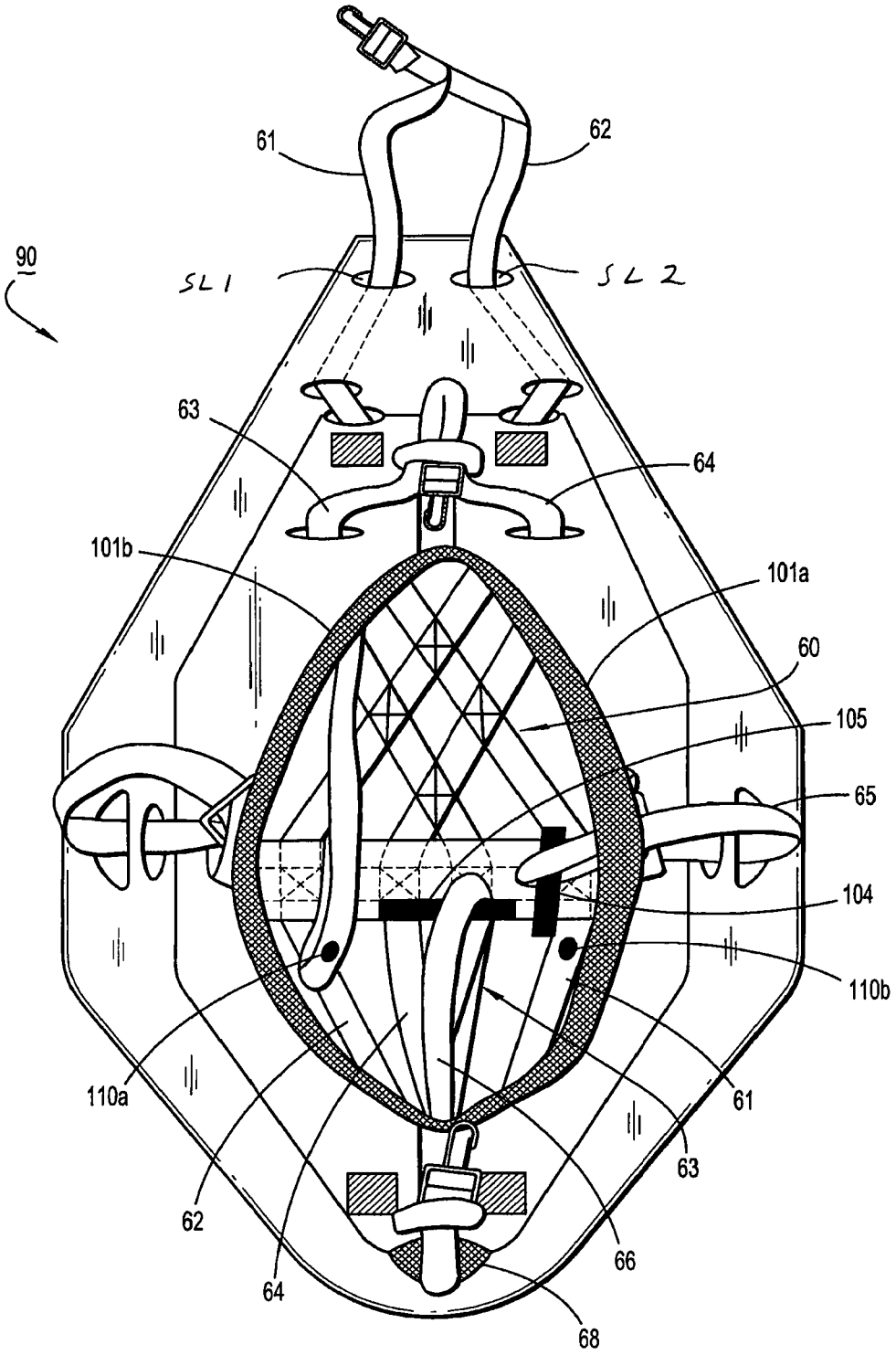

For instance, FIGS. 7-9 schematically illustrate a rescue stretcher device (90) according to another exemplary embodiment of the invention, which is an extension of the rescue stretcher device of FIG. 5 that includes base panel (50), the harness (60) and includes harness bag (100). The harness bag (100) has a bottom layer and a top layer of material that are stitched together around perimeters thereof to form an interior cavity to contains the body of the harness (60). The harness bag (100) includes a plurality of reinforced slots/slits (61*a*, 62*a*, 63*a*, 64*a*, 65*a*, 66*a*) to allow the end portions of the various harness straps, e.g. haul straps (61-62), shoulder straps (63-64), waist straps (65) and groin straps (66) of the harness system (60) to extend from within the interior cavity of the harness bag (100).

The harness bag (100) also includes an elongated reclosable opening (101) formed in the central region of the top surface thereof. In one embodiment, the opening (101) is formed with overlapping mating portions (101*a*, 101*b*) having mating connector mechanisms such as Velcro™ strips, as shown in FIG. 9. The bottom exterior surface of the harness bag (100) may be removably or fixedly attached to the base panel (50), such as by use of corresponding mating Velcro™ strips that are stitched along portions of an exterior of a backside of the harness bag (100) and corresponding Velcro™ strips glued to portions on a surface of the base panel (50). The harness bag (100) also includes a plurality of strap fasteners (102) disposed on the exterior surface of the top layer of the bag (100) in proximity to each of the slots/slits (61*a*, 62*a*, 63*a*, 64*a*, 65*a*, 66*a*), and a plurality of reflective patches (103) formed in proximity to each of the fasteners (102).

As shown in FIG. 8, when the rescue stretcher device (90) is not being used, i.e. is in a non-deployed state, the excess slack of the various straps, e.g. haul straps (61, 62), shoulder straps (63, 64), waist straps (65) and groin straps (66), of the harness device (60) are contained within the harness bag (100). Fasteners (102) are provided to releasably secure the distal end of each strap in a fixed position on an exterior surface of the upper layer of the harness bag (100) near the corresponding strap slits. The fasteners (102) may, for example, be straps having one end stitched to an exterior surface of the top layer of the bag (100) with Velcro™ connectors to strap down and hold the harness strap fasteners of the harness straps.

In other exemplary embodiments, the harness strap fasteners disposed on the exterior of the bag (100) are stowed in pockets provided on the upper exterior surface of the bag (100) in proximity to the strap slits of the harness bag (100).

FIG. 9 illustrates the device in FIG. 8 in the non-deployed state, showing the overlapping mating sides (101*a*, 101*b*) separated along a length of the reclosable opening (101) to enable access the portion of the harness body contained within the interior cavity of the harness bag (100). When in the non-deployed state, excess slack of the elongated straps (63-66) that are stored inside the bag (100) are held in place using holding straps (104, 105) or mating snap button connectors (110*a*, 110*b*).

As shown in FIG. 9, the excess slack of the waist strap (65) is held in place inside the bag (100) using a strap fastener (104) provided by use of a Velcro™ strap. Similarly, a strap fastener (105) can be used to hold the excess slack of the groin strap (66) inside the harness bag (100). Moreover, the excess slack of the shoulder straps (63, 64) can be held in place by connecting the mating snaps (110*a*) on the straps (63, 64) to mating snaps (110*b*) connected to the lower straps (61, 62) along the lengths between the support waist band (67) and the box stitch connection region (68). It is to be understood that for purposes of clarity, FIG. 9 does not show excess slack of the haul straps (61, 62). When in the non-deployed state, strap element (64) is also stowed and releasably secured inside the harness bag (100), using snaps or strap mechanisms as discussed above.

When deploying the rescue stretcher device (90) from the arrangement in FIG. 8, a rescuer need not open the bag (100) via the opening (101) as shown in FIG. 9 to unfasten the straps (104, 105) or to unsnap the snap connections (110*a*, 110*b*). Rather, the slack of the various harness straps (61-66) is released by application of a pulling force on distal ends of respective various harness straps (61-66).

In the exemplary embodiment of FIGS. 7-9, the harness bag (100) is preferably made of a fire retardant material. The harness bag (100) stores and protects the harness (60) from adverse environmental conditions. The harness bag (100) facilitates storage of the harness (60) in an organized manner when in the non-deployed state, avoiding tangling and damage to the harness straps. The harness bag (100) can be used with harness frameworks, such as the harness system of FIG. 6.

It is to be appreciated that a harness with an integral harness bag, as shown in FIGS. 7-9, may be utilized as a stand-alone rescue harness device, such as a full body harness, independent of a base panel as in rescue stretcher device applications. As a stand alone rescue harness system, the harness bag (100) serves as a container for any rescue harness device used in conjunction with the harness bag, to protect and provide stowage for the harness device, with the harness bag further serving to provide some level of back and upper torso support when the harness system with the integral harness bag is donned and deployed by an individual.

In the exemplary embodiment shown in FIGS. 10A-C, 11 and 12, a rescue device (400) is provided that includes a harness (420) with a plurality of harness straps and a harness bag (100) having an interior cavity (C) to contain the harness (420) when the rescue device (400) is in the non-deployed state. Each proximal end of each harness strap is secured within the harness bag (100) and the harness straps include shoulder straps (440A, 440B) and a waist strap (465), having respective distal ends (465D1, 465 D2) that each pass through respective slits (S1, S2) in the harness bag (100) to extend outside of the harness bag (100).

Figure 10A:
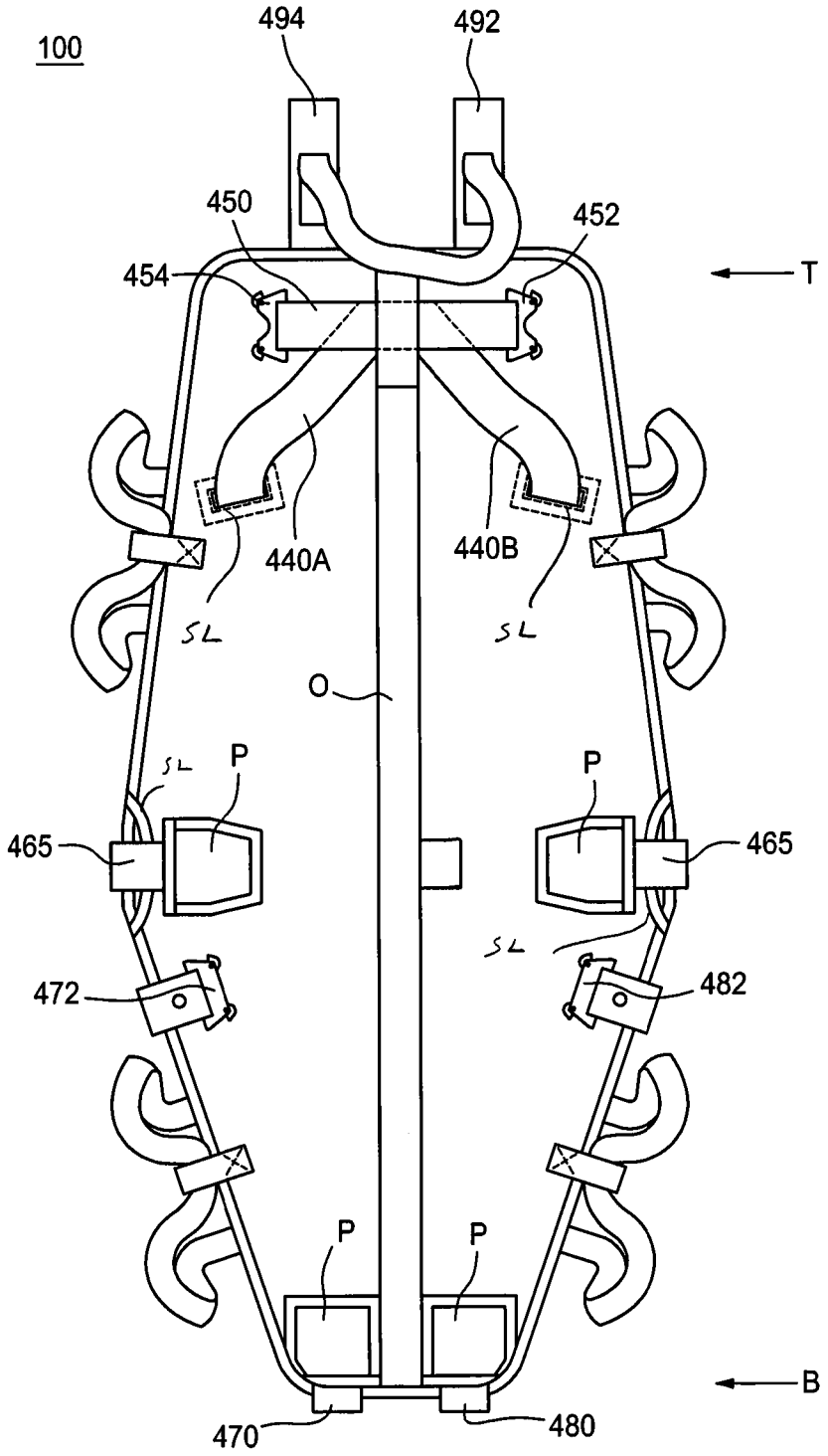
FIGS. 10A-10C illustrate a drag stretcher device according to another exemplary embodiment of the invention.

FIG. 10A shows only harness bag (100), with the rescue device (400) in the non-deployed state, in which excess slack of each harness strap is releasably secured within the harness bag (100) and distal ends of each harness strap are releasably secured on an exterior surface (E) of the harness bag (100).

Figure 10B:
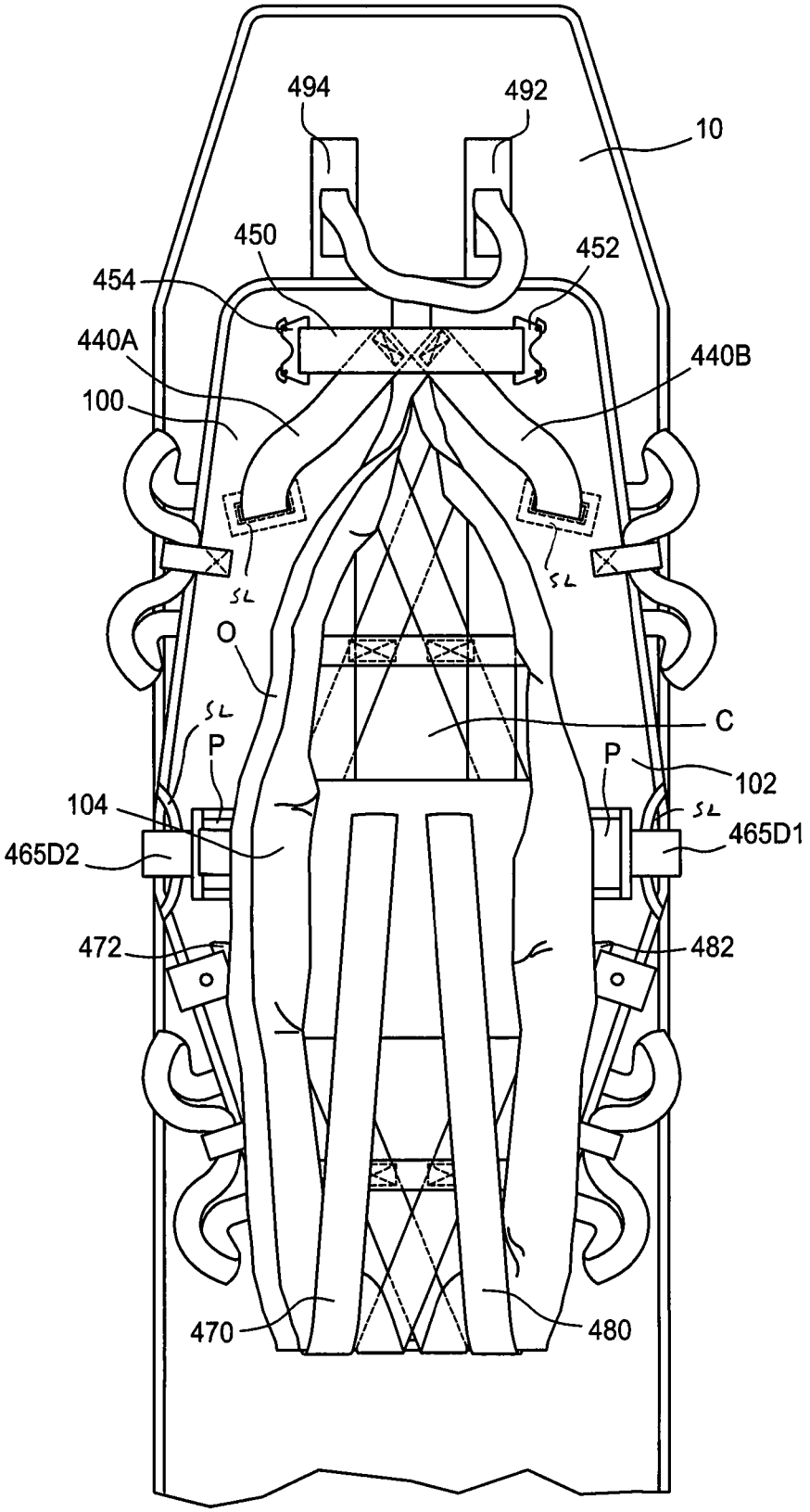

FIG. 10B shows the harness bag (100) secured to the base panel (10), with an interior cavity (C) of the harness bag (100) exposed. It is to be understood that for purposes of clarity, FIG. 10B does not show excess slack of the pull straps (492, 494) and other straps. When in the non-deployed state, a majority of the length of the shoulder straps (440A, 440B), the waist strap (465), and the leg straps (470, 480) are retracted into and stored within the interior cavity (C) of the harness bag (100), and are releasably secured using snaps or strap mechanisms, as discussed above.

Figure 10C:
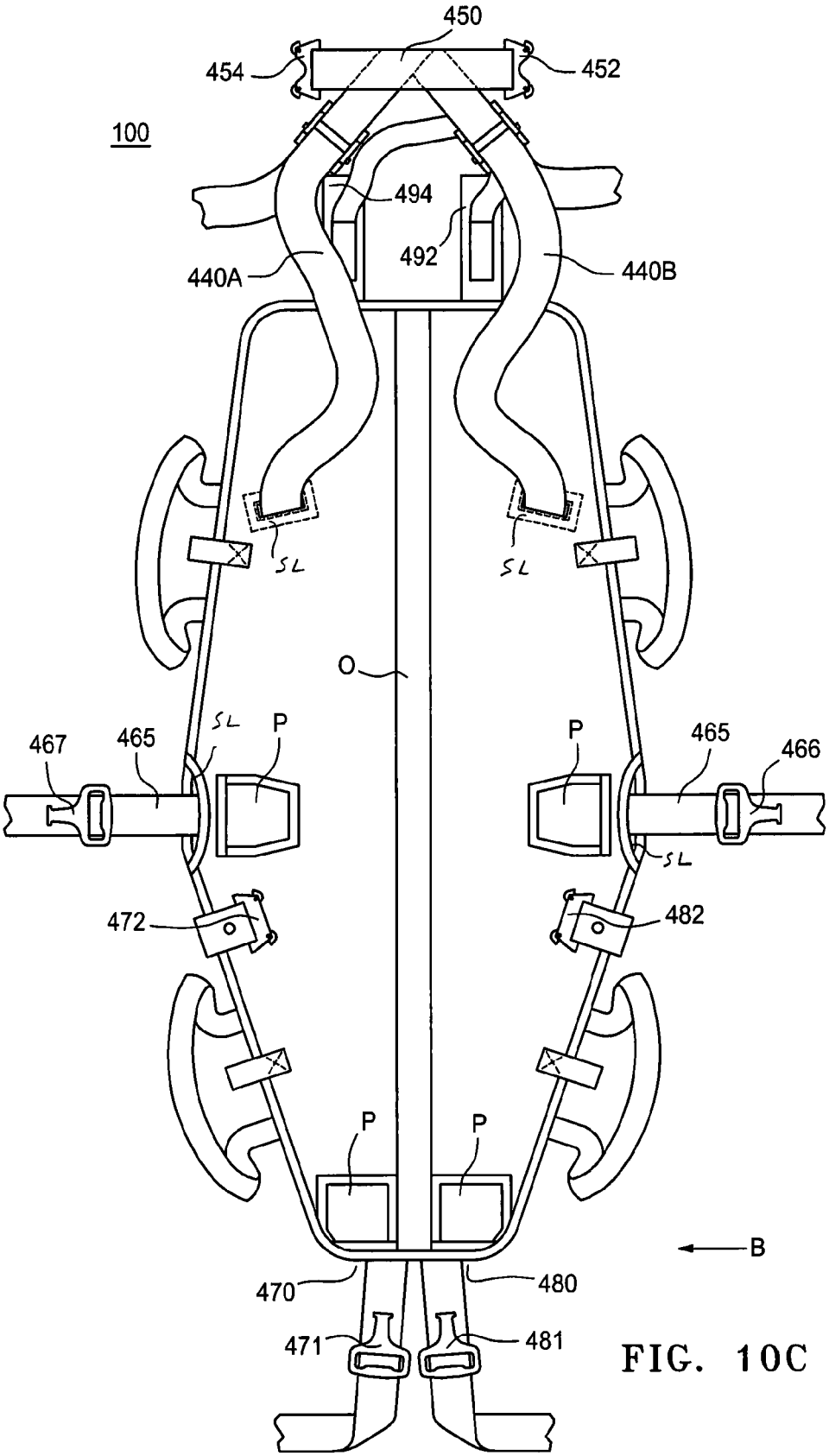

FIG. 10C shows only harness bag (100), with the shoulder straps (440A, 440B), the waist strap (465), and the leg straps (470, 480) extracted from the harness bag (100). First and second connectors (466, 467) are provided on the waist strap (465) with clips that are stored in fastener devices provided on an exterior surface (E) of the harness bag (100). The fastener devices are provided as pockets (P) preferably located in close proximity to respective slot (SL) in a top layer (102) of harness bag (100) that releasably hold in place distal portions of the harness straps (440A, 440B) when the harness (420) is in the non-deployed state.

To deploy the rescue device (400), the distal ends of the harness straps (440A, 440B) are released from the exterior surface (E) of the harness bag (100) and the harness straps (440A, 440B) are extracted from within the harness bag (100) by pulling the harness straps (440A, 440B) through the respective slits (SL) in the harness bag (100). Accordingly, when the rescue device (400) is in a deployed state, an individual (I) being rescued is secured in the rescue device (400) by looping the harness straps (440A, 440B) around the individual (I) and interconnecting the distal ends of the harness straps.

A reclosable opening (O) is provided in the harness bag (100) of the rescue device (400) to provide access to the interior cavity (C) of the harness bag (100) to repack the plurality of harness straps and return the rescue device (400) to the non-deployed state. A plurality of fasteners are disposed within the interior cavity (C) of the harness bag (100) to releasably secure excess slack of the plurality of harness straps (440A, 440B) within the interior cavity (C) of the harness bag (100) when the harness (420) is in the non-deployed state. The plurality of harness straps of the rescue device (400) also include leg straps (470, 480), distal ends of which extend outside of the harness bag (100). The distal ends of the shoulder straps (440A, 440B) are preferably fixedly interconnected, such as by stitching each distal end to the shoulder strap connector (450), as shown in FIGS. 10A-C and 11. Accordingly, an individual (I) being rescued is secured in the rescue device (400) by looping the harness straps around the individual (I) and connecting the distal ends (465D1, 465 D2) of the waist strap (465) to the interconnected distal ends of the shoulder straps (440A, 440B). The individual (I) is secured in the rescue device (400) by looping each leg strap (470, 480) around respective legs of the individual (I) and securing distal ends of each leg strap (n/a) to respective connectors (472, 482), i.e. first and second leg strap receivers, fixed to the exterior surface (E) of the harness bag (100).

To facilitate use by a single rescuer, the base panel (10) of the rescue device (400) is preferably formed of a flexible, non-shape retaining, material.

Figure 12:
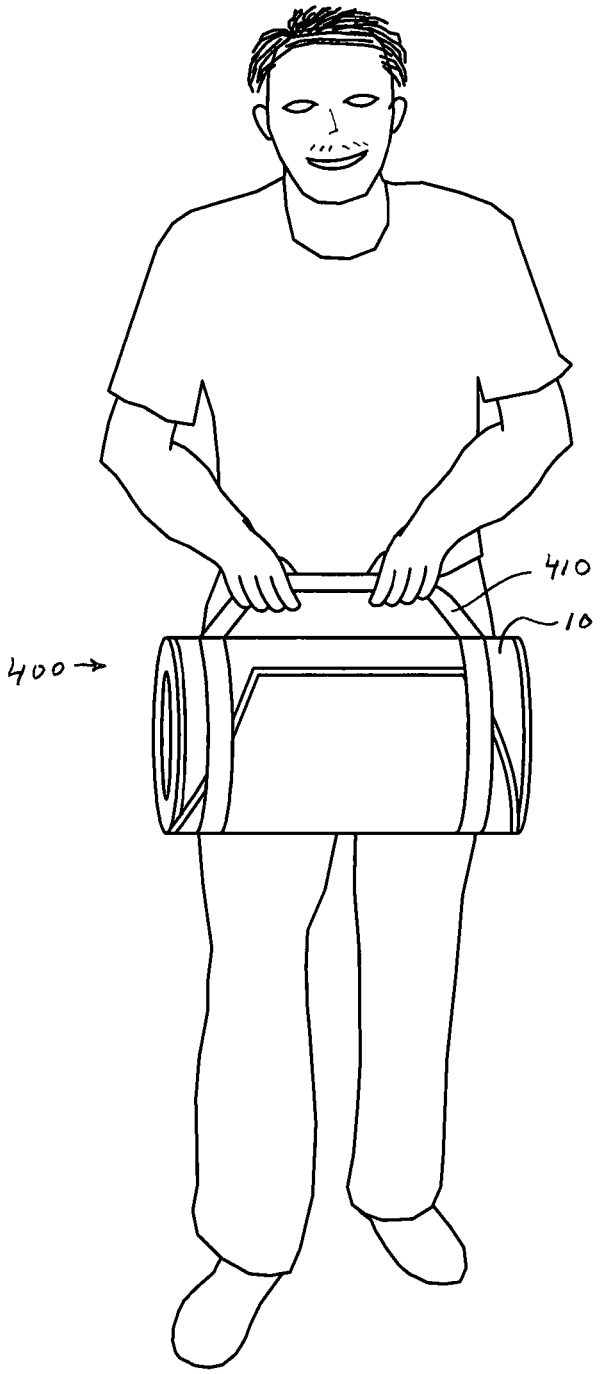
FIG. 12 shows the drag stretcher device in a storage state.

As shown in FIG. 12, when in the non-deployed state, the base panel (10) is rolled in a lengthwise direction with the harness bag (100) contained therein, thereby providing a self-contained and easily transportable rescue device (400).

As shown in FIGS. 10A-C, a plurality of pull straps (492, 494) are provided having proximal ends thereof fixedly attached to the harness (420). When an individual (I) being rescued is positioned in the rescue device (400), the individual (I) and the rescue device (400) can be moved by pulling the pull straps (492, 494). Accordingly, a method is provided for operating a rescue device (400), in which base panel (10) and a harness bag (100) of the rescue device (400) are unrolled, and distal ends of a plurality of harness straps are released from an exterior surface (E) of the harness bag (100).

The plurality of harness straps include shoulder straps (440A, 440B), waist strap (465) and leg straps (470, 480), with distal ends of the shoulder straps (440A, 440B) being fixedly interconnected. The individual (I) to be rescued is then placed on the exterior surface (E) of the harness bag (100), and the harness straps are extended from the interior cavity (C) of the harness bag (100) through respective slots (SL1, SL2) in a top layer (102) the harness bag (100), with proximal ends of each harness strap remaining secured within the harness bag (100). The individual (I) is then secured in the rescue device (400) by looping the extended harness straps around the individual (I) and interconnecting distal ends of the harness straps, with shoulder straps (440A, 440B), a waist strap (465), with distal ends (465D1, 465D2) of the waist strap (465) being connected to the interconnected distal ends of the shoulder straps (440A, 440B).

When the rescue device (400) is in a non-deployed state, excess slack of each harness strap is releasably secured within the harness bag (100) and distal ends of each harness strap are releasably secured on an exterior surface (E) of the harness bag (100), thereby containing the harness straps in the harness bag (100).

Figure 11:
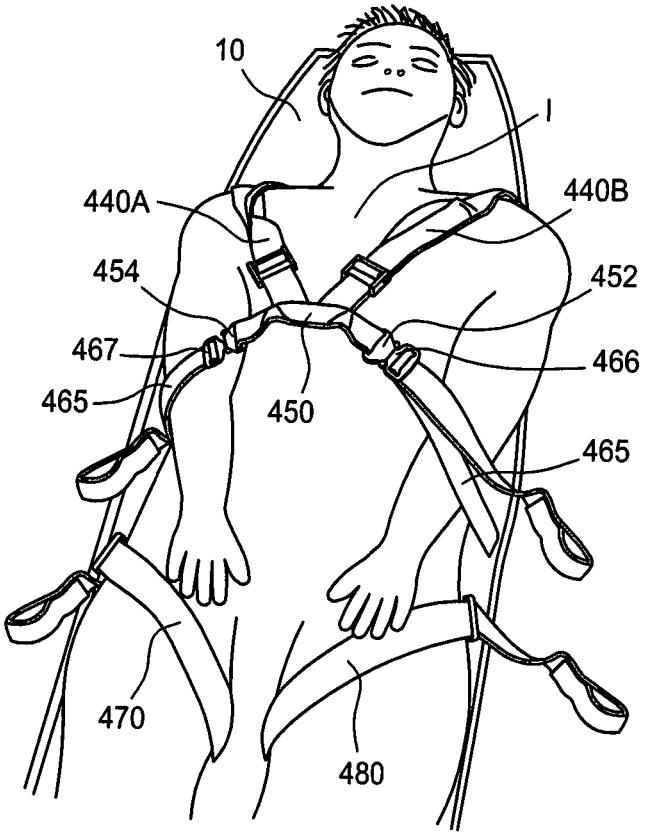
FIG. 11 shows an individual secured in the drag stretcher device of FIGS. 10A-10C.

As shown in FIG. 11, the shoulder harness (440) preferably includes two straps (440A, 440B) arranged to facilitate the individual's (I) head (H) therebetween. A shoulder strap connector (450) secures each of the straps of shoulder harness (440) at distal ends thereof. The shoulder strap connector (450) includes first and second waist strap receivers (452, 454), preferably each being female part a quick release fasteners that also allow for rapid strap tensioning to accommodate different size individuals. The quick release fasteners remain closed when under load, such as AustriAlpin COBRA™ quick release stab-lock fasteners. Preferred embodiments also include fasteners disclosed in U.S. Pat. No. 4,937,923 to McEntire and in U.S. Pat. No. 7,073,235 to Benedict. Corresponding male ends of the quick release fasteners are provided on first and second ends (466, 467) of the waist strap (465).

As also shown in FIG. 11, first and second leg straps (470, 480) are also provided to each secure a leg of the individual (I). Distal ends of the first and second leg straps (470, 480) each include a quick release fastener that connect to first and second leg strap receivers (472, 482), respectively. Proximal ends of the plurality of leg straps (470, 480), shoulder harness (440) and waist strap (465) are fixedly connected to a form a harness (420), with the first and second leg strap receivers (472, 482), respectively. The harness (420) is removably coupled to a base panel (10) and includes pull straps (492, 494) that pass through corresponding slots (SL1, SL2, FIGS. 8-9) of the base panel (10) to securely couple the harness (420) and the harness bag (100) to the base panel (10).

FIG. 12 shows the drag stretcher device (400) in a storage state, being carried by a rescuer via carry handle (410).

It is to be understood that the exemplary embodiments discussed here are merely illustrative of general conceptual frameworks of a rescue stretcher device or rescue sled having a flexible base panel combined with a harness, wherein the harness may include an integral harness bag for protection and stowage of the harness body straps. The harness according to exemplary embodiments of the invention can be designed for different applications and can include any type of harness systems such as full-body harnesses or rescue harness frameworks that otherwise meet NFPA (National Fire Protection Association) standards (or other regulatory standards) for Class I, Class II, and/or Class III service, depending on the application.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed:

1. A rescue device comprising:

a harness comprising a plurality of harness straps;

a harness bag having an interior cavity that contains the harness when in a non-deployed state; and a plurality of fasteners disposed within the interior cavity of the harness bag to releasably secure excess slack of the plurality of harness straps within the interior cavity of the harness bag when the harness is in the non-deployed state, wherein proximal ends of each of the plurality of harness straps are secured within the harness bag, wherein the plurality of harness straps include shoulder straps and a waist strap, each having respective distal ends that each pass through respective slots in the harness bag to extend outside of the harness bag, wherein, when the rescue device is in the non-deployed state, distal ends of each of the plurality of harness straps are releasably secured on an exterior surface of the harness bag, and wherein, to deploy the rescue device, the distal ends of each of the plurality of harness straps are released from the exterior surface of the harness bag and each of the plurality of harness straps are extracted from within the harness bag by pulling each of the plurality of harness straps through the respective slots in the harness bag.

2. The rescue device of claim 1, further comprising a base panel formed of a flexible, non-shape retaining material.

3. The rescue device of claim 2, wherein, when in the non-deployed state, the base panel is rolled in a lengthwise direction with the harness bag contained therein.

4. The rescue device of claim 2, wherein the base panel is removably coupled to the harness bag.

5. The rescue device of claim 4, further comprising:

a plurality of pull straps with proximal ends thereof fixedly attached to the harness, wherein the rescue device, with an individual being rescued positioned therein, is moved by pulling the pull straps.

6. The rescue device of claim 5, wherein each of plurality of pull straps extends through respective slots in the base panel to securely couple the harness and the harness bag to the base panel.

7. The rescue device of claim 1, wherein the harness bag comprises a plurality of fastener devices disposed on the exterior surface of the harness bag in proximity to each slot to releasably hold in place the distal portions of the harness straps when the harness is in the non-deployed state.

8. The rescue device of claim 1, wherein the plurality of harness straps further include leg straps, distal ends of which extend outside of the harness bag, and wherein distal ends of the waist strap and of the leg straps are secured in respective pockets fixed on an exterior surface of the harness bag when in the non-deployed state.

9. The rescue device of claim 8, wherein distal ends of the shoulder straps are fixedly interconnected.

10. The rescue device of claim 9, wherein an individual being rescued is secured in the rescue device by looping the plurality of harness straps around the individual and connecting distal ends of the waist strap to the interconnected distal ends of the shoulder straps.

11. The rescue device of claim 10, wherein securing the individual in the rescue device further comprises looping each leg strap around respective legs of the individual and securing distal ends of each leg strap to respective connectors fixed to the exterior surface of the harness bag.

12. The rescue device of claim 1, wherein, when in a deployed state, an individual being rescued is secured in the rescue device by looping each of the plurality of harness straps around the individual and interconnecting the distal ends of each of the plurality of harness straps.

13. The rescue device of claim 1, further comprising a reclosable opening in the harness bag that provides access to an interior cavity of the harness bag to repack the harness straps, to return the rescue device from a deployed state to the non-deployed state.

* * * * *